US006243941B1

(12) United States Patent
Kashiwaya et al.

(10) Patent No.: US 6,243,941 B1
(45) Date of Patent: Jun. 12, 2001

(54) THERMAL HEAD FABRICATION METHOD

(75) Inventors: Makoto Kashiwaya; Junji Nakada, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/356,506

(22) Filed: Jul. 19, 1999

(30) Foreign Application Priority Data

Jul. 17, 1998 (JP) ..... 10-203935

(51) Int. Cl.[7] ..... H05B 3/00
(52) U.S. Cl. ..... 29/611; 347/203
(58) Field of Search ..... 29/611, 890.1; 347/200, 203; 427/122, 123, 249; 428/908.8

(56) References Cited

U.S. PATENT DOCUMENTS 5,238,705 * 8/1993 Hayashi ..... 427/122
6,002,418 * 12/1999 Yoneda ..... 347/203

FOREIGN PATENT DOCUMENTS 61-53955 * 11/1986 (JP) .
7132628 * 5/1995 (JP) .

* cited by examiner

*Primary Examiner*—Lee Young
*Assistant Examiner*—Sean Smith
(74) *Attorney, Agent, or Firm*—Sughrue, Mion, Zinn, Macpeak & Seas, PLLC

(57) ABSTRACT

The thermal head fabrication method provides a thermal head having a lower protective layer composed of at least one sub-layer on heat generators and electrodes, an intermediate protective layer composed of at least one sub-layer on the lower protective layer and an upper protective layer composed of at least one sub-layer with carbon as a main component on the intermediate protective layer. At least one of surfaces of the lower and intermediate protective layers is cleaned by ion irradiation processing, by polishing with a lapping tape or an adhesive tape, or by heating processing in vacuum before forming a higher protective layer. This allows the thermal head to have excellent adhesion between any individual layers and sufficient durability to ensure that the thermal recording of high-quality images is consistently performed over an extended period of time.

9 Claims, 2 Drawing Sheets

THERMAL HEAD FABRICATION METHOD

BACKGROUND OF THE INVENTION

This invention relates to the art of method for fabricating thermal heads for thermal recording which are used in various types of printers, plotters, facsimile, recorders and the like as a recording device.

Thermal materials comprising a thermal recording layer on a substrate of a film or the like are commonly used to record images produced in diagnosis by ultrasonic scanning (sonography).

This recording method, also referred to as thermal recording, eliminates the need for wet processing and offers several advantages including convenience in handling. Hence, in recent years, the use of the thermal recording system is not limited to small-scale applications such as diagnosis by ultrasonic scanning and an extension to those areas of medical diagnoses such as CT, MRI and X-ray photography where large and high-quality images are required is under review.

As is well known, thermal recording involves the use of a thermal head having a glaze, in which heating elements are arranged in one direction (main scanning direction) and, with the glaze urged at small pressure against a thermal material, the two members are moved relative to each other in an auxiliary scanning direction perpendicular to the main scanning direction and energy is applied to the respective heating elements in accordance with the image to be recorded in order to heat a thermal recording layer of the thermal material, thereby accomplishing image reproduction.

A protective film is formed on the surface of the glaze of the thermal head in order to protect the heating elements and the like. The protective film is usually made of wear-resistant ceramics such as silicon nitride and the like; however, during thermal recording, the surface of the protective film is heated and kept in sliding contact with the thermal material so that the protective film gradually wears and deteriorates upon repeated recording; hence, the ability of the protective film to protect the heating elements is impaired such that the intended image recording is no longer possible (the head has lost its function).

Particularly in the applications such as the aforementioned medical use which require multiple gradation images of high quality, the trend is toward ensuring the desired high image quality by adopting highly rigid substrates such as polyester film and the like and also by increasing the setting values of recording temperature and pressure at which the thermal head is urged against the thermal material. Therefore, load to be put on the protective film, of the thermal head is large, and wear and corrosion of the protective film are made more likely to progress.

With a view to preventing the wear of the protective film or the thermal head and improving its durability, a number of techniques to improve the performance of the protective film have been considered. Among others, a carbon protective film with carbon as a main component, that is, a carbon-based protective film (hereinafter referred to as carbon protective layer) is known as a protective film excellent in resistance to wear and corrosion.

For example, Examined Published Japanese Patent Application (KOKOKU) No. 61-53955 discloses a thermal head comprising a carbon protective layer having a Vickers hardness of 4500 kg/mm$^2$ or more as the protective film of the thermal head and, moreover, Unexamined Published Japanese Patent Application (KOKAI) No. 7-132628 discloses a thermal head which has a dual protective film comprising a lower protective layer composed of a silicon-based compound and an upper carbon protective layer (diamond-like carbon layer), whereupon each of such carbon protective layer has properties quite similar to those of diamond including a very high hardness and chemical stability; hence, the carbon protective layer presents sufficiently excellent properties to prevent wear and corrosion which may be caused by the sliding contact with thermal materials.

One of problems in thermal recording employing such a thermal head is in effecting cracking and peeling in the protective film rather easily. Such cracking and peeling give rise to wear and corrosion which results in reduction of durability of the thermal head whereupon the thermal head is not capable of exhibiting high reliability over an extended period of time.

Studies of inventors of the present invention reveal that adhesion between individual layers constituting the protective film and the like play an important role. In other words, if the adhesion between the individual layers constituting the protective film is bad, such cracking and peeling will be effected on the thermal head with repetition of heating and cooling.

SUMMARY OF THE INVENTION

The present invention has been accomplished under these Circumstances and has an object for providing a method for fabricating a thermal head comprising a lower protective layer, an intermediate protective layer and an upper protective layer which has excellent adhesion therebetween.

In order to achieve the above object, the first aspect of the invention provides a method for fabricating a thermal head, comprising the steps of:

forming a lower protective layer composed of at least one sub-layer on heat generators and electrodes;

forming an intermediate protective layer composed of at least one sub-layer on this lower protective layer; and forming an upper protective layer composed of at least one sub-layer with carbon as a main component on this intermediate protective layer;

wherein an ion irradiation processing is performed on at least one of a surface of the lower protective layer before forming the intermediate protective layer and a surface of the intermediate protective layer before forming the upper protective layer.

It is preferable that the above-mentioned lower protective layer includes an Si-based nitride as a main component and that the above-mentioned ion irradiation processing is performed by irradiating ions in a plasma which has been changed from a mixed gas including an inert gas and a nitrogen gas.

It is also preferable that the above-described intermediate protective layer includes at least one metal or an alloy thereof selected from the group consisting of metals in Group IVA, Group VA and Group VIA of the periodic table, and Si (silicon) and Ge (germanium), as well as mixture thereof and that the above-mentioned ion irradiation processing is performed by irradiating ions that exist in a plasma which has been changed from an inert gas.

The second aspect of the invention provides a method for fabricating a thermal head, comprising the steps of:

forming a lower protective layer composed of at least one sub-layer on heat generators and electrodes;

forming an intermediate protective layer composed of at least one sub-layer on this lower protective layer; and forming an upper protective layer composed of at least one sub-layer with carbon as a main component on this intermediate protective layer;

wherein a lapping tape is urged against the surface of the above-mentioned lower protective layer which is then polished therewith before the above-mentioned intermediate protective layer is formed.

It is preferable when the above-mentioned surface is polished, the transport rate of the lapping tape is 0.1–50 m/sec.

It is also preferable that, when the above-mentioned surface is polished, the pressure urged with the lapping tape is 0.05–10 g/mm$^2$.

It is further preferable that, when the above-mentioned surface is polished, the thermal head is oscillated at 10–100 Hz.

The third aspect of the invention provides a method for fabricating a thermal head, comprising the steps of:

forming a lower protective layer composed of at least one sub-layer on heat generators and electrodes;

forming an intermediate protective layer composed of at least one sub-layer on this lower protective layer; and forming an upper protective layer composed of at least one sub-layer with carbon as a main component on this intermediate protective layer;

wherein an adhesive tape is applied to a surface of the above-mentioned lower protective layer before the above-mentioned intermediate protective layer is formed; and wherein, after the adhesive tape is peeled off, the above-mentioned intermediate protective layer is formed.

The fourth aspect of the invention provides a method for fabrication a thermal head, comprising the steps of:

forming a lower protective layer composed of at least one sub-layer on heat generators and electrodes;

forming an intermediate, protective layer composed of at least one sub-layer on this lower protective layer; and forming an upper protective layer composed of at least one sub-layer with carbon as a main-component on this intermediate protective layer wherein the lower protective layer is subjected to heating processing in vacuum before the above-mentioned intermediate protective layer is formed; and wherein, after the above-mentioned lower protective layer is subjected to the heating processing, the above-mentioned intermediate protective layer is formed.

DETAILED DESCRIPTION OF THE INVENTION

The method for fabricating a thermal head of the invention will now be described in detail with reference to the preferred embodiments shown in the accompanying drawings.

Figure 1:
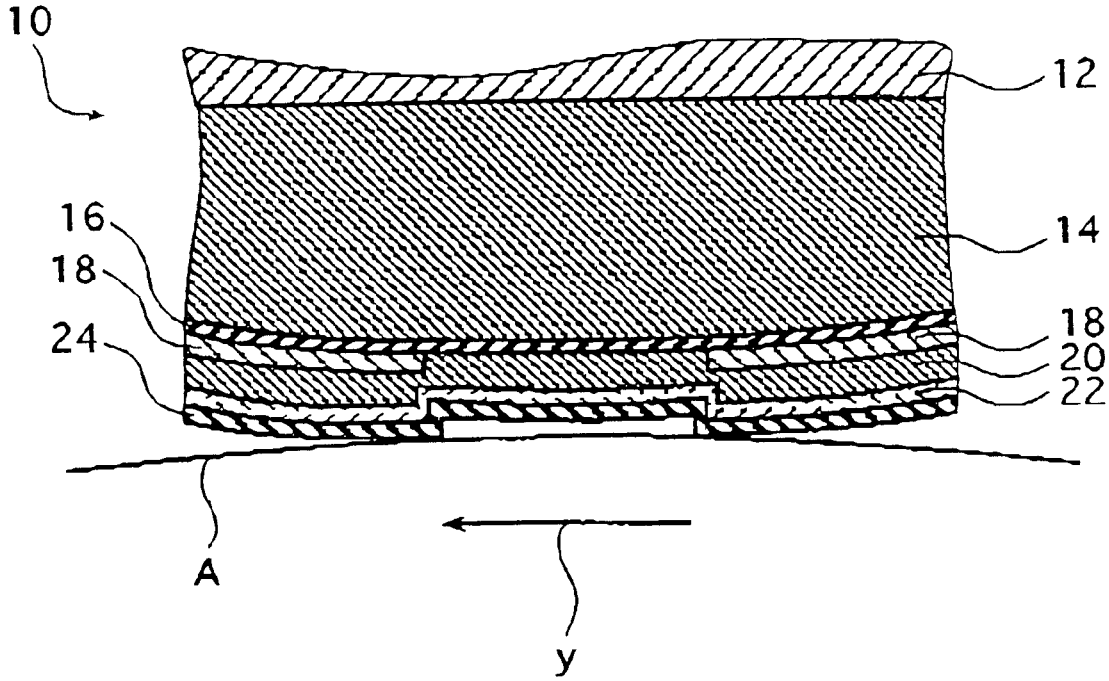
FIG. 1 is a conceptual diagram showing an embodiment of a structure of a heating element of a thermal head fabricated by the invention.

FIG. 1 is a conceptual diagram showing a structure of a heating element of a thermal head fabricated by a fabrication method according to an embodiment of the invention.

The illustrated thermal head 10 is capable of image recording on thermal sheets of up to, for example, B4 size at a recording (pixel) density of, say, about 300 dpi. Except for a protective film, the thermal head 10 has a known structure in that it has a glaze in which the heating elements performing thermal recording on the thermal material A are arranged in one direction, that is, in the main scanning direction (in a direction perpendicular to a surface plane of paper in FIG. 1).

It should be noted that the thermal head 10 of the invention is not particularly limited in such aspects as the width (in the main scanning direction), resolution (recording density) and recording gradation; preferably, the head width ranges from 5 cm to 50 cm, the resolution is at least 6 dots/mm (ca. 150 dpi), and the recording gradation consists of at least 256 levels.

The thermal material A which is subjected to thermal recording employing the thermal head 10 according to the invention is a conventional thermal material that includes a substrate of a transparent polyethylene terephthalate (PET) film or the like a surface of which is overlaid with a thermal recording layer.

Exemplified as a lubricant to be included in the thermal material A is a pigment, a metallic soap, wax or the like.

Specifically, illustrated as the pigment are zinc oxide, calcium carbonate, barium sulfate, titanium oxide, lithopone, talc, agalmatolite, kaolin, aluminum hydroxide, almorphous silica, styrene resin, a formalin condensate, a fluoroethyiene resin, a urea resin and the like; illustrated as the metallic soap are emulsions of metallic salts of higher fatty acids such as calcum stearate, aluminum stearate and the like; and illustrated as the wax are stearic acid, paraffin wax, microcrystalline wax, carnauba wax, methylolstearoamide, polyethylene wax, silicone, any of emulsions thereof and the like.

As shown in FIG. 1, the thermal head 10 comprises a glaze layer (heat accumulating layer) 14 formed on a substrate 12 (the glaze layer 14 is shown under the substrate 12 in FIG. 1 since the thermal head 10 is urged downward against the thermal material A), a heater (heat generator, 14 i.e., heat-generating resistor) 16 formed on the glaze layer 14, electrodes 18 formed on the heater 16 and a protective film which protects the heating elements having the heater 16 and the electrodes 18, and the like.

The illustrated protective film of the thermal head 10 is composed of three layers: a lower protective layer 20 superposed on the heater 16 and the electrodes 18; an intermediate protective layer (hereinafter called as intermediate layer) 22 formed on the lower protective layer 20; and a carbon-based protective layer, that is, a carbon protective layer 24 formed on the intermediate layer 22.

The thermal head 10 according to the present embodiment has essentially the same structure as known thermal head except for the protective film.

Therefore, the structure of other layers and constituent materials thereof are not limited in any particular way and various known structures and materials may be employed. Specifically, the substrate 12 is capable of using various electrically insulating materials including heat-resistant glass and ceramics such as alumina, silica and magnesia; the glaze layer 14 is capable of using heat-resistant glass, heat resistant resins including a polyimide resin and the like; the heater 16 is capable of using heat-generating resistors such as Nichrome (Ni-Cr), tantalum metal, tantalum nitride and the like; and the electrodes 16 are capable of using electrically conductive materials such as aluminum, copper, gold, silver and the like.

As the glaze (heating element), two types are known as being usually available: a thin-film type heating element which is formed by a "thin-film" forming technique such as vacuum evaporation, chemical vapor deposition (CVD), sputtering or the like and a photoetching technique; and a thick-film type heating element which is formed by a "thick-film" forming technique comprising the steps of printing (e.g., screen printing) and firing and an etching technique. In the thermal head 10 for use in the invention, the glaze may be formed by any of the above techniques.

For the lower protective layer 20 to be formed in the thermal head 10 for use in the invention, various known materials are available as long as they have sufficient heat resistance, corrosion resistance and wear resistance to serve as the protective film of the thermal head and, preferably, a variety of ceramic-based materials are exemplified.

Specific materials include silicon nitride ($Si_3N_4$), silicon carbide (SiC), tantalum oxide ($Ta_2C_5$), aluminum oxide ($Al_2O_3$), SIALON (Si-Al-O-N), LASION (La-Si-O-N), silicon oxide ($SiO_2$), aluminum nitride (AlN), boron nitride (BN), selenium oxide (SeO), titanium nitride (TiN), titanium carbide (TiC), titanium carbide nitride (TiCN), chromium nitride (CrN) and mixtures thereof. Among others, nitrides and carbides are preferably used in various aspects such as easy film deposition, manufacturing cost, wear resistance against mechanical wear and chemical Year and the like, Silicon nitride, silicon carbide, SIALON and the like are more preferably used. Additives such as metals may be incorporated in small amounts into the lower protective layer 20 to adjust physical properties thereof.

Methods of forming the lower protective layer 20 are not limited in any particular way and known methods of forming ceramic films (layers) may be employed to form the lower protective layer 20 by applying the aforementioned thick-film technique, thin-film technique or the like. Among those methods, CVD can be advantageously applied.

As is well known, CVD is a technique for depositing a film on a substrate comprising the steps of: applying energy such as heat, light or the like to a gaseous material introduced into a reaction chamber; inducing various chemical reactions and depositing a substance overlapping the substrate. By employing such CVD, the lower protective layer 20 which is extremely dense and has no defect such as crack or the like can be formed whereby the thermal head which is excellent in durability and advantageous in image quality can be fabricated.

The thickness of the lower protective layer 20 is not limited to any particular value but it ranges preferably from about 0.2 $\mu$m to about 50 $\mu$m, more preferably from about 2 $\mu$m to about 20 $\mu$m. If the thickness of the lower protective layer 20 is within the stated ranges, preferred results are obtained in various aspects such as the balance between wear resistance and heat conductivity (that is, recording sensitivity) and so forth.

The lower protective layer 20 may comprise multiple sub-layers. In this case, multiple sub-layers maybe formed of different materials or multiple sub-layers different in density may be formed of one material. Alternatively, the above two forming methods may be combined to obtain sub-layers.

The illustrated thermal head 10 has, as a preferred embodiment, a three-layered protective film composed of the lower protective layer 20, the intermediate layer 22 deposited on such lower protective layer 20 and the carbon protective layer 24 deposited on the intermediate layer.

Since the carbon protective layer 24 has very high chemical stability as described above, the carbon protective layer 24 formed on the lower protective layer 20 can effectively protect the lower protective layer 20, the heat-generating resistor 16, the electrodes 18 and the like from chemical corrosion, thereby extending the service life of the thermal head 10 and, moreover, the intermediate layer 22 enhances adhesion between the lower protective layer 20 and the carbon protective layer 24, shock absorption and the like, whereupon the thermal head having sufficient durability, high reliability and excellent serviceability over an extended period of time can be realized.

The intermediate layer 22 formed in the thermal head 10 is preferably based on at least one component selected from the group consisting of metals in Group IVA (titanium group), Group VA (vanadium group) and Group VIA (chromium group) of the periodic table, as well as silicon (Si) and germanium (Ge) in aspects such as the adhesion between the upper carbon protective layer 24 and the lower protective layer 20 and the durability of the carbon protective layer 24.

Preferred specific examples include Si, Ge, titanium (Ti), tantalum (Ta), molybdenum (Mo) and mixtures thereof. Among others, Si and Mo are more preferably used in the binding with carbon and other aspects. Most preferably, Si is used.

Methods of forming the intermediate layer 22 are not limited in any particular way and any known film deposition methods may be used in accordance with the material of the intermediate layer 22 by applying the aforementioned thick-film, thin-film forming techniques or the like. A preferred method includes sputtering, but plasma-assisted CVD is also advantageously available.

The intermediate layer 22 may also comprise multiple sub-layers. In this case, multiple sub-layers may be formed of different materials or multiple sub-layers different in density may be formed of one material. Alternatively, the above two techniques may be combined to obtain sub-layers.

Prior to forming the intermediate layer 22, ion irradiation, lapping and the like treatment are preferably performed to the lower protective layer 20. Thus, the adhesion between the lower protective layer 20 and the intermediate layer 22 and the adhesion between the intermediate layer 22 and the carbon protective layer 24 can be improved, whereupon the thermal head can have the improved durability.

In this case, roughness of a surface of the lower protective layer 20 is not limited to any particular value and Ra value is preferably between 1 nm and 0.1 $\mu$m.

The ion irradiation processing of the invention preferably includes plasma irradiation, ion implantation and the like.

In the illustrated thermal head 10, the carbon protective layer 24 that has carbon as a main component is formed on the intermediate layer 22. As described above, the carbon protective layer 24 is chemically very stable so that it effectively prevents chemical corrosion of the lower protective layer 20 and advantageously enhances durability of the thermal head.

Prior to forming the carbon protective layer 24, such ion irradiation, lapping and the like processing as described above are preferably performed to the intermediate layer 22. Thus, the adhesion between the intermediate layer 22 and the carbon protective layer 24 is further improved whereupon durability of the thermal head is improved.

The carbon-based protective layer 24 of the invention refers to a carbon film that contains more than 50 atm % of carbon and, preferably, comprises carbon and inevitable impurities. In the thermal head according to the invention, as other components than carbon which comprise the carbon protective layer 24, advantageously illustrated are hydrocarbon, nitrogen, fluorine, Si, Ti and the like. In the case of hydrogen, nitrogen and fluorine, the content thereof in the carbon protective layer 24 is preferably less than 50 atm %, whereas in the case of Si and Ti, the content thereof in the carbon protective layer 24 is preferably 20 atm % or less.

Methods of forming such carbon protective layer 24 are not limited in any particular way and all the known film forming (or film deposition) processes corresponding to respective compositions of the carbon protective layer 24 may be employed. Examples preferably include sputtering, particularly magnetron sputtering, and CVD, particularly, plasma-assisted CVD.

As described above, in the thermal head 10 according to the invention, when the lower protective layer 20 or the intermediate layer 22 is formed, the surface thereof is cleansed so as to improve adhesive between the layer 20 or 22 and its associated upper layer, that is, the intermediate layer 22 or the carbon protective layer 24.

As also described above, the thermal head having the carbon protective layer 24 has excellent characteristics in aspects such as durability, corrosion resistance, wear resistance and the like so that the thermal head exerting high reliability over an extended period of time can be realized. However, when the adhesion between any individual layers is bad, cracking and peeling are likely effected on the thermal head with repetition of heating and cooling.

In contrast to the above, in the thermal head 10 according to the invention, surfaces of respective lower layers have been cleansed to improve adhesion between any individual layers prior to forming respective layers composing the protective film whereupon a fabrication method of the thermal head having an excellent adhesion can be realized.

Preferred examples of the fabrication method of such thermal head having an excellent adhesion are illustrated below.

First of all, a method is preferably illustrated in which the lower protective layer 20 is formed and, subsequently, the surface thereof is subjected to ion irradiation processing such as plasma irradiation or the like. The ion irradiation can cleanse and flatten the surface of the lower protective layer 20 whereupon a preferred adhesive can be obtained when the intermediate layer 22 and the carbon protective layer 24 are formed. In the ion irradiation processing, a gas selected from the group consisting of oxygen, hydrocarbon, inert gas and mixture thereof is changed into plasma and, subsequently, the resultant plasma may be irradiated on the lower protective layer 20. The ion irradiation processing is preferably performed after the surface of the lower protective layer 20 has been subjected to lapping processing with a router or the like.

Another method is preferably illustrated in which the intermediate layer 22 is formed and, subsequently, the surface thereof is subjected to ion irradiation processing such as plasma irradiation or the like. Lapping processing instead of ion irradiation processing such as plasma irradiation or the like may be performed. A method for performing the lapping processing is not limited in any particularly way and the method for performing the lapping processing by urging a lapping paper against the lower protective layer 20 or the intermediate layer 22 is preferably illustrated. A condition for performing the lapping processing is not limited in any particular way and the sliding rate of lapping is preferably between 0.1 m/sec and 50 m/sec; urging pressure of lapping material is preferably between 0.05 and 10 g/mm$^2$; and the thermal head is preferably oscillated at between 10 and 100 Hz when the lapping processing is performed.

Another method is advantageously available in which after the lower protective layer 20 and the intermediate layer 22 are respectively formed, adhesive tapes are applied on the respective surfaces thereof; then, the respective adhesive tapes are peeled therefrom; and, subsequently, the respective associated upper layers thereof, that is, the intermediate layer 22 and the carbon protective layer 24, are formed. In this case, meaning of applying and peeling the adhesive tape is considered to lie in removing foreign matters.

Further another method is advantageously available in which, after the lower protective layer 20 and the intermediate layer 22 are respectively formed, the respective surfaces thereof are subjected to heating processing in vacuum; and the respective associated upper layers thereof, that is, the intermediate layer 22 and the carbon protective layer 24 are formed. Also in this case, meaning of heating is considered to lie in removing foreign matters.

The hardness of the carbon protective layer 24 is not limited to any particular value as far as the carbon protective layer 24 has a sufficient hardness to serve as the protective film of the thermal head. For example, the carbon protective layer 24 having a Vickers hardness from 3000 kg/mm$^2$ to 5000 kg/mm$^2$ is advantageously illustrated. The hardness may be constant or varied in the thickness direction of the carbon protective layer 24. In latter case, the harness variation may be continuous or stepwise.

The carbon protective layer 24 may be formed at an elevated temperature of between about 50° C. and about 400° C. and, particularly, at a temperature at which the thermal head 10 is in a practical use. In this method, the adhesion between the carbon protective layer 24 and the intermediate layer 22 as well as between the intermediate layer 22 and the lower protective layer 20 can further be improved whereupon excellent durability can be imparted to the carbon protective layer 24 which is then protected from cracking and peeling caused by a heat shock and a mechanical impact due to a foreign matter entered between the thermal material and the thermal head during the thermal recording, as well as from deterioration of properties and wear-away of the carbon layer due to high power recording. Heating may be performed by a heating device such as a heater or the like or energizing the thermal head 10.

In the thermal head 10 with a three-layered film comprising the lower protective layer 20, the intermediate layer 22 and the carbon protective layer 24, the thickness each of the intermediate layer 22 and the carbon protective layer 24 is not limited to any particular value. The intermediate layer 22 has preferably a thickness of from 0.05 $\mu$m to 2 $\mu$m and, more preferably, from 0.1 $\mu$m to 1 $\mu$m. The carbon protective layer 24 has preferably a thickness of from 0.5 $\mu$m to 5 $\mu$m and, more preferably, from 1 $\mu$m to 3 $\mu$m.

In the case of the intermediate layer 22 which is much thicker than the carbon protective layer 24, cracking and peeling may often taken place in the intermediate layer 22. When the intermediate layer 22 is much thinner than the carbon protective layer 24 to the contrary, the intermediate layer 22 does not fully execute its desired function. On the other hand, if the thickness of the intermediate layer 22 and the carbon protective layer 24 are within the above specified ranges, the adhesion of the intermediate layer 22 to the lower layer thereof and the shock absorption thereof as well as the functions such as durability and the like of the carbon protective layer 24 can be realized in a stable and well-balanced manner.

Figure 2:
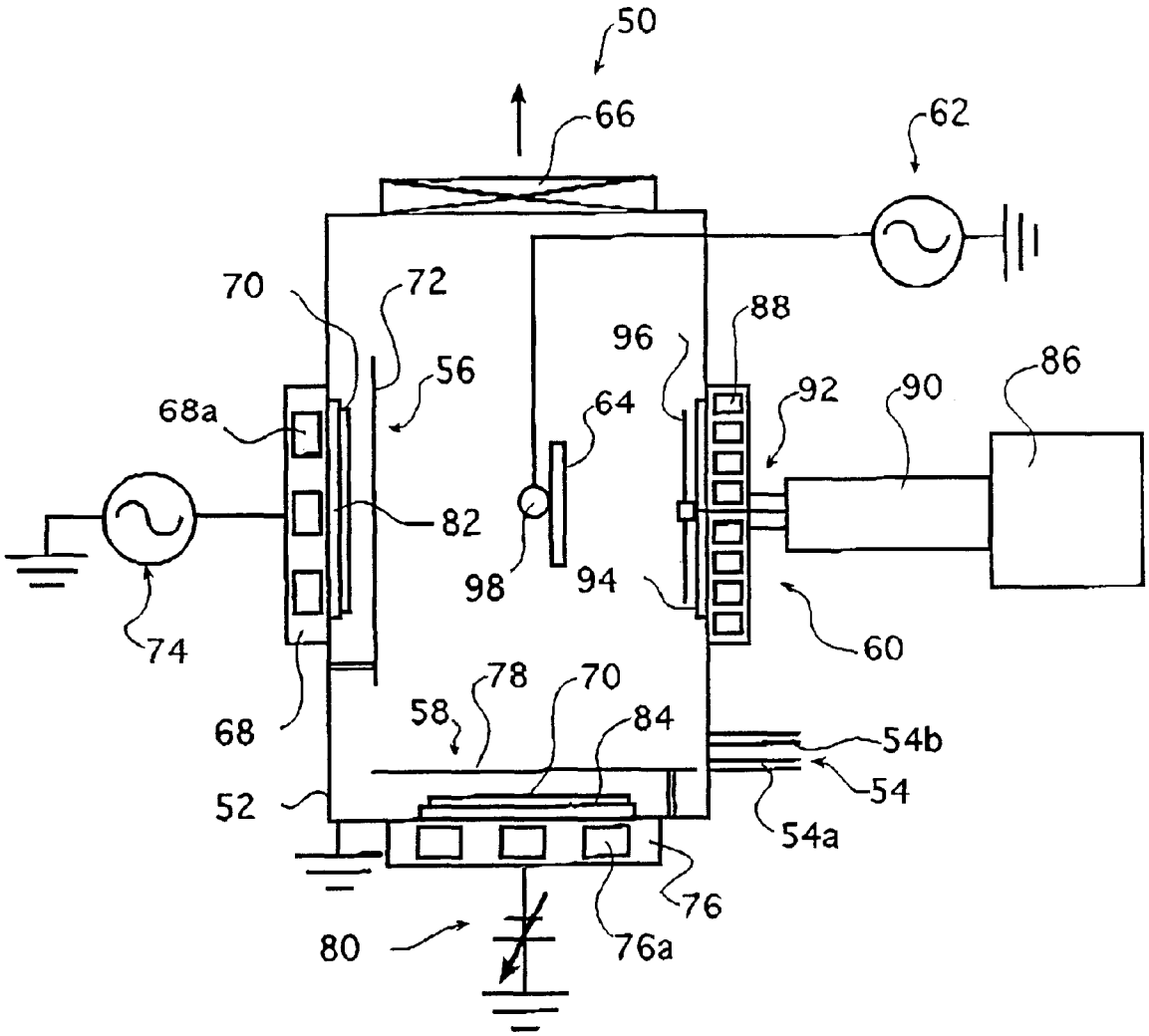
FIG. 2 is a conceptual diagram showing an exemplary film deposition apparatus for use in a thermal head fabrication method according to an embodiment of the invention.

FIG. 2 is a conceptual diagram showing an exemplary film deposition apparatus which can be advantageously used in performing each deposition processing of the respective protective layers in the thermal head according to the invention.

The illustrated film deposition apparatus 50 in FIG. 2 comprises a vacuum chamber 52, a gas introducing section 54, a first sputter device 56, a second sputter device 58, a plasma generating device 60, a bias source 62 and a substrate holder 64 as basic components.

The film deposition apparatus 50 comprises three film deposition devices located in the system or the vacuum chamber 52, the two being performed by sputtering and the other by plasma-assisted CVD. A plurality of layers with different compositions from each other can be successively deposited on the substrate by means of the film deposition apparatus 50 without releasing the inside of the system to the atmosphere.

Therefore, if the film deposition apparatus 50 is utilized, the intermediate layer 22 (or the lower protective layer 20) and the carbon protective layer 24 can be formed in an easy and efficient way by, for example, sputtering using different targets or the combination of sputtering with plasma-assisted CVD.

The vacuum chamber 52 is preferably formed of a non-magnetic material such as SUS 304, and the like and is provided with a vacuum pump-down device 66 that discharges gases from the vacuum chamber 52 to reduce the pressure (e.g., to make the vacuum) in the inside thereof (inside the film deposition system). Sites in the vacuum chamber 52 where plasma develops or an arc is produced by plasma generating electromagnetic waves may be covered as required with an insulating member such as MC nylon, Teflon (PTFE) or the like.

The gas introducing section 54 includes two gas introducing pipes 54*a* and 54*b*. As an exemplary example, the gas introducing pipe 54*a* introduces a plasma generating gas, while the gas introducing pipe 54*b* introduces a reactive gas for use in the plasma-assisted CVD.

Examples of the plasma generating gases are inert gases such as helium, neon and the like. On the other hand, examples of the reactive gases for producing the carbon protective layer 24 are hydrocarbon compounds in gaseous forms such as methane, ethane, propane, ethylene, acetylene, benzene and the like. Examples of the reactive gases for producing the intermediate layer 22 are various gases including materials used for forming the intermediate layer 22.

To effect sputtering, a target to be sputtered is placed on a cathode which is rendered at negative potential and a plasma is generated on the surface of the target, whereby atoms are struck out of the target to attach to the surface of the opposed substrate and deposit thereon allowing the film to be formed.

The first sputter device 56 and the second sputter device 58 are intended for sputtering film deposition on the surface of the substrate. The former comprises a cathode 68, an area where the target 70 is to be placed, a shutter 72, a high frequency (RF) power supply 74 and other components. The latter comprises a cathode 76, an area where the target 70 is to be placed, a shutter 78, a direct current (DC) power supply 80 and other components.

As seen from the above configuration, the first sputter device 56 and the second sputter device 58 have basically a similar configuration except that positions of the respective components and the respective power supplies are different. Therefore, the first putter device 56 is now described as a typical example except for the different parts.

In order to generate a plasma on the surface of the target 70, the RF power supply 74 is connected to the cathode 68 in the first sputter device 56 whereas the negative side of the DC power supply 80 is connected to the cathode 76 and is supplied with an electric current for sputtering in the second sputter device 58.

An output and property of each power supply are not limited to any particular value and may appropriately be selected so as to be necessary and sufficient for producing a desired film. For example, in the above apparatus for forming the above-described intermediate layer 22 and the carbon protective layer 24, the RF power supply 74 may be a source with a maximum output of 10 kw at a high frequency of 13.56 MHz whereas the DC power supply 80 may be a DC source with a maximum output of 10 kw at a negative potential.

At least one of the above power supplies, particularly serving for film deposition of the carbon protective layer 24, is preferably combined with a modulator by which pulse modulation, for example, modulation into a pulse state at between 2 kHz and 100 kHz is made possible.

In the illustrated example, a backing plate 82 (84) made of oxygen-free copper, stainless steel or the like is fixed to the cathode 68 and then the target 70 is fixed thereon by an In-based solder or a mechanical fixing device. Examples of preferred materials of the target 70 used to form the intermediate layer 22 include metals of Groups IVA, VA and VIA of the periodic table and monocrystalline Ge and Si and the like. As an exemplary illustration, the target 70 used to form the carbon protective layer 24 is preferably made of sintered carbon, glassy carbon or the like.

The illustrated apparatus performs magnetron sputtering, in which magnets 68*a* (76*a*) are placed within the cathode 68. The magnetron sputtering confines plasma within a magnetic field formed on the surface of the target 70. Magnetron sputtering is preferred since it achieves high deposition rates.

The illustrated film deposition apparatus 50 performs film depositions such as the carbon protective layer 24 and the like using the plasma-assisted CVD that utilizes microwave ECR discharge in which the plasma is generated by a microwave and an ECR magnetic field. The plasma generating device 60 comprises a microwave source 86, magnets 88, a microwave guide 90, a coaxial transformer 92, a dielectric plate 94 and a radial antenna 96 and the like.

The microwave source 86 may appropriately be selected from those in commercial use which produce outputs necessary and sufficient to produce the carbon protective layer 24 or the like.

As magnets 88 for generating the ECR magnetic field, permanent magnets or electromagnets which are capable of forming the desired magnetic field may appropriately be employed.

Microwaves are introduced into the vacuum chamber 52 using the microwave guide 90, the coaxial transformer 92, the dielectric plate 94 and the like.

The substrate holder 64 is used to fix in position a member (film deposition substrate) on which a film is deposited such as the thermal head (its body) 10 or the like.

The film deposition apparatus 50 as shown in FIG. 2 comprises three film deposition devices. The substrate holder 64 is held on a rotary member 98 which rotates to rock the substrate holder 64 so that the glaze on the substrate can be opposed to the respective film deposition devices, that is, the sputter devices 56 and 58, and the plasma generating devices 60 which performs the plasma-assisted CVD.

The distance between the substrate holder 64 and the target 70 or the radial antenna 96 is adjustable by a known method. The distance between the substrate and the target 70 or the radial antenna 96 may appropriately be set so as to provide a uniform thickness profile.

The surface of the lower protective layer 20 and the intermediate layer 22 are optionally etched to provide a rough surface. Moreover, oxygen etching is preferably utilized for adjusting surface free energy of the carbon protective layer 24. The film deposition is preferably performed with a negative bias voltage being applied to the substrate in order to obtain a hard film by the plasma-assisted CVD.

To do this, the bias source 62 which applies a radio-frequency voltage is connected to the substrate holder 64 in the film deposition apparatus 50. The radio-frequency self-bias voltage is preferably used in the plasma-assisted CVD.

On the foregoing pages, the method for fabricating a thermal head of the invention has been described in detail but the present invention is in no way limited to the stated embodiments and various improvements and modifications can of course be made without departing from the spirit and scope of the invention.

As described above in detail, the present invention can realize the thermal head 10 having the protective film comprising the multiple-layered construction which has significantly reduced corrosion and wear and which has sufficient durability effected by greatly enhancing the adhesion between any individual layers to ensure that the thermal recording of high-quality images is consistently performed over an extended period of time.

EXAMPLES

The invention will further be illustrated by means of the following specific examples.

Example 1

A thermal head as the base was fabricated in the same way as in a known thermal head fabrication method by forming the heat accumulating layer 14 on the substrate 12, forming the heater 16 on the thus formed heat accumulating layer 14, forming the electrodes 18 on the thus formed heater 16 and forming a silicon nitride ($Si_3N_4$) film deposited in a thickness of 11 $\mu$m on the thus formed electrodes 18. Therefore, in Example 1, the silicon nitride film serves as the lower protective layer 20 on which the intermediate layer 22 is formed. The carbon protective layer 24 is then formed on this intermediate layer 22.

The film deposition apparatus 50 as shown in FIG. 2 was used to form the intermediate layer 22 and the carbon protective layer 24 on the base thermal head as described above. The film deposition apparatus 50 is further described below.

a. Vacuum Chamber 52

The vacuum chamber 52 made of SUS 304 and having a capacity of 0.5 $m^3$ was used. The vacuum pump-down device 66 used in the vacuum chamber 52 comprised one unit each of a rotary pump having a pumping speed of 1,500 L/min, a mechanical booster pump having a pumping speed of 12,000 L/min and a turbomolecular pump having a pumping speed of 3,000 L/sec. An orifice valve was fitted at the suction inlet of the turbomolecular pump to allow for 10 to 100% adjustment of the degree of opening.

b. Gas Introducing Section 54

A mass flow controller permitting a maximum flow rate of 100 to 500 sccm and a stainless steel pipe having a diameter of 6 mm were used to form two gas introducing pipes 54*a* and 54*b*, the former being used for introducing a plasma generating gas and the latter being used for introducing a reactive gas.

c. First Sputter Device 56 and Second Sputter Device 58

The cathodes 68 and 76 used were each in a rectangular form having a width of 600 mm and a height of 200 mm, with Sm-Co magnets being incorporated as the permanent magnets 68*a* and 76*a*. Rectangular oxygen-free copper members were attached to the cathodes 68 and 76 with In-based solder as the backing plates 82 and 84. The interior of the cathodes 68 and 76 was water-cooled to cool the magnets 68*a* and 76*a*, the cathodes 68 and 76 and the rear side of each of the backing plates 82 and 84.

The DC power supply 80 that is at negative potential capable of producing a maximum output of 10 kW was used in combination with a modulator so that the DC power was capable of pulse modulation at frequencies of between 2 kHz and 100 kHz.

d. Plasma Generating Device 60

The microwave source 86 oscillating at a frequency of 2.45 GHz and producing a maximum output of 1.5 kW was employed. The generated microwave was guided to the neighborhood of the vacuum chamber 52 by means of the microwave guide 90, converted in the coaxial transformer 92 and directed to the radial antenna 96 in the vacuum chamber 52.

The plasma generating part used was in a rectangular form having a width of 600 mm and a height of 200 mm.

A magnetic field for ECR was produced by arranging a plurality of Sm-Co magnets used as the magnets 88 in a pattern to conform to the shape of the dielectric plate 94.

e. Substrate Holder 64

By operating the rotary member 98, the substrate (that is, the thermal head 10) fixed thereon is kept opposed to one of the targets 70 in the first sputter device 56 and the second sputter device 58 and the radial antenna 96 in the plasma generating device 60.

The distance between the substrate and each target 70 was set at 100 mm when sputtering was used to form the intermediate layer 22 and the carbon protective layer 24 as described below.

In addition, the area of the substrate holder 64 in which the thermal head was held was set at a floating potential in order to enable the application of an etching radio-frequency voltage. A heater was also provided on the surface of the substrate holder 64 for film deposition with heating.

f. Bias Source 62

An RF power supply was connected to the substrate holder 64 via a matching box.

The RF power supply had a frequency of 13.56 MHz and could produce a maximum output of 3 kW. It was also adapted to be such that, by monitoring the self-bias voltage, the RP output could be adjusted over a range of −100 to −500 V.

In this apparatus 50, the bias source 62 also serves as an etching device.

Fabrication of Thermal Read:

In the above-described film deposition apparatus 50, the thermal head 10 (or heating elements) in which the lower protective layer 20 was formed as described above was secured to the substrate holder 64 such that the thermal head 10 would be kept opposed to the position where the target 70 of the first sputter device 56 was arranged. All areas of the thermal head 10 but the area where the intermediate layer 22 was to be formed were previously masked.

With continued pump-down, a mixed gas of argon and nitrogen was introduced through the gas introducing section 54 and the pressure in the vacuum chamber 52 was adjusted to $5.0\times10^{-3}$ Torr by means of the orifice valve fitted in the vacuum chamber 52. Subsequently, a bias voltage of −300 V was applied to the substrate by driving the plasma generating device 60 and ions in plasma were irradiated.

After the end of the ion irradiation, a monocrystalline silicon and a sintered graphite member each as the target 70 were fixed (i.e., attached by means of In-based solder) on the backing plate 82 in the first sputter device 56 and on the backing plate 84 in the second sputter device 58, respectively. Then, after the vacuum chamber 52 was pumped down to the internal pressure of $2.5\times150^{-6}$ Torr, the argon gas flow rate and the orifice valve were adjusted so as to maintain the internal pressure in the vacuum chamber 52 at $5.0\times10^{-3}$ Torr, whereupon an RF power of 0.5kW was applied to the target 70 for 5 minutes, with the shutter 72 being closed.

Subsequently, with the internal pressure in the vacuum chamber 52 kept at the stated level, the supply power was raised to 5 kW and then the shutter 72 was opened. The sputtering was performed until the intermediate layer 22 had a thickness of 0.2 $\mu$m. Thus, a silicon layer with a thickness of 0.2 $\mu$m was formed as the intermediate layer 22. To control the thickness of the silicon layer to be formed, the deposition rate was determined previously and the time required to reach a specified film thickness was calculated.

After the intermediate layer 22 was formed, with continued pump-down, an argon gas was introduced through the gas introducing section 54 and the pressure in the vacuum chamber 52 was adjusted to $5.0\times10^{-3}$ Torr by means of the orifice valve fitted in the vacuum chamber 52. Subsequently, a bias voltage of −300 V was applied to the substrate by driving the plasma generating device 60 and ions in plasma were irradiated.

After the end of this ion irradiation, the heating elements were opposed by the rotary member 98 to the target 70 (i.e. the sintered graphite member) of the second sputter device 58. Then, the argon gas flow rate and the orifice valve were adjusted so as to maintain the internal pressure in the vacuum chamber 52 at $5.0\times10^{-3}$ Torr, and a DC power of 0.5 kW was applied to the target 70 for 5 minutes with the shutter 78 being closed.

Subsequently, with the internal pressure in the vacuum chamber 52 kept at the stated level, the DC power was raised to 5 kW and the shutter 78 was opened. The sputtering was performed until the carbon protective layer 24 had a thickness of 2 $\mu$m.

To control the thickness of the carbon protective layer 24 to be formed, the deposition rate was determined previously and the time required to reach a specified film thickness was calculated.

After the carbon protective layer 24 was formed, the shutter 78 was closed. Then, oxygen gas was introduced through the gas introducing section 54 and the pressure in the vacuum chamber 52 was adjusted to $5.0\times10^{-3}$ Torr. Subsequently, the carbon protective layer 24 was subjected to oxygen-etching for 40 minutes at a self-bias voltage of −200 V thereby fabricating the thermal head 10.

Evaluation of Performance:

The thus fabricated thermal head 10 was incorporated into the thermal recording apparatus and thermal recording of a solid image was performed using a thermal material of B4 size (dry image recording film CR-DP for medical application of Fuji Photo Film Co., Ltd.).

The result was that neither cracking nor peeling was found on the protective film of the thermal head 10 up to 25,000 sheets of recording.

Example 2

In the thermal head 10 (heating elements) which had been fabricated up to the step of depositing the lower protective layer 20, the lower protective layer 20 was polished with a lapping tape. Then, film deposition of the intermediate layer 22 and the carbon protective layer 24 was performed in the film deposition apparatus 50 in the same way as in Example 1. The lapping tape used was of a chromium oxide #8000 type. The transport rates thereof adopted were three references of 0.5, 5 and 50 m/min. The pressure at which the lapping tape is urged against the thermal head 10 was 0.5 g/mm$^2$. The thermal head 10 was provided with an oscillation of 50 Hz.

Then, in the same way as in Example 1, the thermal head 10 (heating elements) which had been fabricated up to the lower protective layer 20 was secured to the substrate holder 64 in the film deposition apparatus 50 so as to keep the thermal head 10 opposed to the position where the target 70 of the first sputter device 56 was arranged. In this case, all areas of the thermal head 10 but the area where the intermediate layer 22 was to be formed were previously masked.

The monocrystalline silicon and a sintered graphite member each as the target 70 were fixed (i.e., attached by means of In-based solder) on the backing plate 82 in the first sputter device 56 and on the backing plate 84 in the second sputter device 58, respectively. Then, the vacuum chamber 52 was evacuated to an internal pressure of $5.0\times10^{-6}$ Torr and the argon gas flow rate and the orifice valve were adjusted so as to maintain the internal pressure in the vacuum chamber 52 at $2.5\times10^{-3}$ Torr, whereupon an RF power of 0.5 kW was applied to the target 70 for 5 minutes, with the shutter 72 being closed.

Subsequently, with the internal pressure in the vacuum chamber 52 kept at the stated level, the RF power was raised to 2 kW and then the shutter 72 was opened. The sputtering was performed until the intermediate layer 22 had a thickness of 0.2 $\mu$m. Thus, a silicon layer with a thickness of 0.2 $\mu$m was formed as the intermediate layer 22. To control the thickness of the silicon layer to be formed, the deposition rate was determined previously and the time required to reach a specified film thickness was calculated.

After the intermediate layer 22 was formed, the heating elements were opposed by the rotary member 98 to the target 70 (i.e. the sintered graphite member) of the second sputter device 58. Then, the argon gas flow rate and the orifice valve were adjusted so as to maintain the internal pressure in the vacuum chamber 52 at $2.5\times10^{-3}$ Torr, and a DC power of 0.5 kW was applied to the target 70 for 5 minutes with the shutter 78 being closed.

Subsequently, with the internal pressure in the vacuum chamber 52 kept at the stated level, the DC power was raised to 5 kW and the shutter 78 was opened. The sputtering was performed until the carbon protective layer 24 had a thickness of 2 $\mu$m.

To control the thickness of the carbon protective layer 24 to be formed, the deposition rate was determined previously and the time required to reach a specified film thickness was calculated.

After the carbon protective layer 24 was formed, the shutter 78 was closed, oxygen gas was introduced through the gas introducing section 54, the pressure in the vacuum chamber 52 was adjusted to $5.0\times10^{-3}$ Torr and the carbon protective layer 24 was subjected to oxygen-etching for 40 minutes at a self-bias voltage of −200 V thereby fabricating the thermal head 10.

Evaluation of Performance:

The thus fabricated thermal head 10 was incorporated into the thermal recording apparatus and thermal recording of a solid image was performed using a thermal material of B4 size (dry image recording film CR-DP for medical application of Fuji Photo Film Co., Ltd.).

The result was that no unevenness of the image was found up to 25,000 sheets of recording. This indicates that no defect such as cracking or the like was found on the protective film of the thermal head 10.

Example 3

In the thermal head 10 (heating elements) which had been fabricated up to the step of depositing the lower protective layer 20 in the same way as in Example 2, the lower protective layer 20 was polished with a lapping tape. Then, film deposition of the intermediate layer 22 and the carbon protective layer 24 was performed in the film deposition apparatus 50. The lapping tape used was of a chromium oxide #2000 type. In this example, the transport rate thereof adopted was 5 m/min. The pressures at which the lapping tape was urged against the thermal head 10 were 0.1, 5 and 10 g/mm$^2$. The thermal head was provided with an oscillation of 50 Hz.

Then, in the same way as in Example 2, the intermediate layer 22 and the carbon protective layer 24 were deposited whereupon oxygen-etching was performed on the carbon protective layer 24 also in the same way as in Example 2 to fabricate the thermal head 10.

Evaluation of Performance:

The thus fabricated thermal head 10 was incorporated into the thermal recording apparatus and thermal recording of a solid image was performed using a thermal material of B4 size (dry image recording film CR-DP for medical application of Fuji Photo Film Co., Ltd.).

The result was that no unevenness of the image was found up to 25,000 sheets of recording. This indicates that no defect such as cracking or the like was found on the protective film of the thermal head 10.

Example 4

In the thermal head 10 (heating elements) which had been fabricated up to the step of depositing the lower protective layer 20 in the same way as in Examples 2 and 3, the lower protective layer 20 was polished with a lapping tape. Then, film deposition of the intermediate layer 22 and the carbon protective layer 24 was performed in the film deposition apparatus 50. The lapping tape used was of a chromium oxide #8000 type. The transport rate thereof adopted was 5 m/min. The pressure at which the lapping tape was urged against the thermal head 10 was 0.5 g/mm$^2$. In this Example, the thermal head was provided with two references of oscillations of 10 and 100 Hz.

Then, in the same way as in Example 2, the intermediate layer 22 and the carbon protective layer 24 were deposited whereupon oxygen-etching was performed on the carbon protective layer 24 also in the same way as in Example 2 to fabricate the thermal head 10.

Evaluation of Performance:

The thus fabricated thermal head 10 was incorporated into the thermal recording apparatus and thermal recording of a solid image was performed using a thermal material of B4 size (dry image recording film CR-DP for medical application of Fuji Photo Film Co., Ltd.).

The result was that no unevenness of the image was found up to 25,000 sheets of recording. This indicates, as described above, that no defect such as cracking or the like was found on the protective film of the thermal head 10.

Comparative Example 1

In the thermal head 10 (heating elements) which had been fabricated up to the step of depositing the lower protective layer 20 in the same way as in Example 2, the lower protective layer 20 was polished with a lapping tape. Then, film deposition of the intermediate layer 22 and the carbon protective layer 24 was performed in the film deposition apparatus 50. The lapping tape used was of a chromium oxide #2000 type. The transport rates thereof adopted were two references of 0.05 and 100 m/min. The pressure at which the lapping tape was urged against the thermal head 10 was 0.5 g/mm$^2$. The thermal head 10 was provided with an oscillation of 50 Hz.

Evaluation of Performance:

The thus fabricated thermal head 10 was incorporated into the thermal recording apparatus and thermal recording of a solid image was performed suing a thermal material of B4 size (dry image recording film CR-DP for medical application of Fuji Photo Film Co., Ltd.).

The result was that unevenness in the image was found before 5,000 sheets were recorded. This indicates that some defect such as cracking or the like was generated on the protective film of the thermal head 10.

Comparative Example 2

In the thermal head 10 (heating elements) which had been fabricated up to the step of depositing the lower protective layer 20 in the same way as in Comparative Example 1, the lower protective layer 20 was polished with a lapping tape. Then, film deposition of the intermediate layer 22 and the carbon protective layer 24 was performed in the film deposition apparatus 50. The lapping tape used was of a chromium oxide #20000 type. The transport rate thereof adopted was 5 m/min. The pressures at which the lapping tape was urged against the thermal head 10 were two references of 0.01 and 20 g/mm$^2$. The thermal head 10 was provided with an oscillation of 50 Hz.

Evaluation of Performance:

The thus fabricated thermal head 10 was incorporated into the thermal recording apparatus and thermal recording of a solid image was performed using a thermal material of B4 size (dry image recording film CR-DP for medical application of Fuji Photo Film Co., Ltd.).

The result was that unevenness in the image was found before 5,000 sheets were recorded. This indicates, in the same manner as described above, that some defect such as cracking or the like was generated on the protective film of the thermal head 10.

Comparative Example 3

In the thermal head 10 (heating elements) which had been fabricated up to the step of depositing the lower protective layer 20 in the same way as in Comparative Examples 1 and 2, the lower protective layer 20 was polished with a lapping tape. Then, film deposition of the intermediate layer 22 and the carbon protective layer 24 was performed in the film deposition apparatus 50. The lapping tape used was of a chromium oxide #20000 type. The transport rate thereof adopted was 5 m/min. The pressure at which the lapping tape was urged against the thermal head 10 was 0.5 g/mm$^2$. The thermal head 10 was provided with two references of oscillations of 2 Hz and 200 Hz.

Evaluation of Performance:

The thus fabricated thermal head 10 was incorporated into the thermal recording apparatus and thermal recording of a solid image was performed using a thermal material of B4 size (dry image recording film CR-DP for medical application of Fuji Photo Film Co., Ltd.).

The result was that unevenness in the image was found before 5,000 sheets were recorded. This indicates, in the same manner as described above, that some defect such as cracking or the like was generated on the protective film of the thermal head 10.

Example 6

In the thermal head 10 (heating elements) which had been fabricated up to the step of depositing the lower protective layer 20 in the same manner as in Examples 2 and 3, an adhesive tape was applied to the lower protective layer 20 and then peeled therefrom. Thereafter, film deposition of the intermediate layer 22 and the carbon protective layer 24 was performed in the film deposition apparatus 50. The adhesive tape was of a highly heat resistant type. The carbon protective layer 24 was subjected to oxygen-etching as in Examples 2 and 3 to fabricate the thermal head 10.

Evaluation of Performance:

The thus fabricated thermal head 10 was incorporated into the thermal recording apparatus and thermal recording of a solid image was performed using a thermal material of B4 size (dry image recording film CR-DP for medical application of Fuji Photo Film Co., Ltd.).

The result was that no peeling of the protective film from the thermal head 10 was effected until 25,000 sheets were recorded, which is considered to result from application of the adhesive tape that removed foreign matters.

Example 7

In the thermal head 10 (heating elements) which had been fabricated up to the step of depositing the lower protective layer 20 in the same manner as in Examples 2, 3 and 4, the lower protective layer 20 was subjected to heating processing in vacuum. Thereafter, film deposition of the intermediate layer 22 and the carbon protective layer 24 was performed in the film deposition apparatus 50 whereupon oxygen-etching was performed on the carbon protective layer 24 also in the same manner as in Examples 2, 3 and 4 to fabricate the thermal head 10.

Evaluation of Performance:

The thus fabricated thermal head 10 was incorporated into the thermal recording apparatus and thermal recording of a solid image was performed using a thermal material of B4 size (dry image recording film CR-DP for medical application of Fuji Photo Film Co., Ltd.).

The result was that no resistance change of the heat-generating resistor 16 in the thermal head 10 was found up to 25,000 sheets of recording. The same effect was obtained as in the case of providing the heat-generating resistor 16 with a heating history.

Comparative Example 4

Film deposition of the intermediate layer 22 and the carbon protective layer 24 was performed in the film deposition apparatus 50 in the same way as in Example 7 except that the lower protective layer 20 is not subjected to heating processing in vacuum. Then, oxygen-etching was performed on the carbon protective layer 24 also in the same way as in Example 7 to fabricate the thermal head 10.

Evaluation of Performance:

The thus fabricated thermal head 10 was incorporated into the thermal recording apparatus and thermal recording of a solid image was performed using a thermal material of B4 size (dry image recording film CR-DP for medical application of Fuji Photo Film Co., Ltd.).

The result was that unevenness in the image was found before 5,000 sheets were recorded. It is considered that such unevenness was caused by the resistance change of the heat-generating resistor 16 in the thermal head 10.

These results clearly demonstrate the effectiveness of the thermal head of the present invention.

What is claimed is:

1. A method for fabricating a thermal head, comprising the steps of:

forming a lower protective layer composed of at least one sub-layer on heat generators and electrodes;

forming an intermediate protective layer composed of at least one sub-layer on said lower protective layer; and forming an upper protective layer composed of at least one sub-layer with carbon as a main component on said intermediate protective layer;

wherein an ion irradiation processing is performed on at least one of a surface of the lower protective layer before forming the intermediate protective layer and a surface of the intermediate protective layer before forming the upper protective layer.

2. The method for fabricating the thermal head according to claim 1, wherein said lower protective layer includes an Si-based nitride as a main component; and wherein said ion irradiation processing is performed by irradiating ions in a plasma which has been changed from a mixed gas including an inert gas and a nitrogen gas.

3. The method for fabricating the thermal head according to claim 1, wherein said intermediate protective layer includes at least one metal or an alloy thereof selected from the group consisting of metals in Group IVA, Group VA and Group VIA of the periodic table, and Si (silicon) and Ge (germanium), as well as mixture thereof and wherein said ion irradiation processing is performed by irradiating ions that exist in a plasma which has been changed from an inert gas.

4. The method for fabricating a thermal head, comprising the steps of:

forming a lower protective layer composed of at least one sub-layer on heat generators and electrodes;

forming an intermediate protective layer composed of at least one sub-layer on said lower protective layer; and forming an upper protective layer composed of at least one sub-layer with carbon as a main component on said intermediate protective layer;

wherein a lapping tape is urged against a surface of said lower protective layer which is then polished therewith before said intermediate protective layer is formed.

5. The method for fabricating the thermal head according to claim 4, wherein, when said surface is polished, the transport rate of the lapping tape if 0.1–50 m/sec.

6. The method for fabricating the thermal head according to claim 4, wherein, when said surface is polished, the pressure urged with the lapping tape if 0.05–10 g/mm$^2$.

7. The method for fabricating the thermal head according to claim 4, wherein, when said surface is polished, the thermal head is oscillated at 10–100 Hz.

8. The method for fabricating the thermal head, comprising the steps of:

forming a lower protective layer composed of at least one sub-layer on heat generators and electrodes;

forming an intermediate protective layer composed of at least one sub-layer on said lower protective layer; and forming an upper protective layer composed of at least one sub-layer with carbon as a main component on said intermediate protective layer;

wherein an adhesive tape is applied to a surface of said lower protective layer before said intermediate protective layer is formed; and wherein, after said adhesive tape is peeled off, said intermediate protective layer is formed.

9. The method for fabricating the thermal head, comprising the steps of:

forming a lower protective layer composed of at least one sub-layer on heat generators and electrodes;

forming an intermediate protective layer composed of at least one sub-layer on said lower protective layer; and forming an upper protective layer composed of at least one sub-layer with carbon as a main component on said intermediate protective layer;

wherein said lower protective layer is subjected to heating processing in vacuum before said intermediate protective layer is formed; and wherein, after said lower protective layer is subjected to heating processing, said intermediate protective layer is formed.

* * * * *